US006981605B2

(12) United States Patent
Kasuya et al.

(10) Patent No.: US 6,981,605 B2
(45) Date of Patent: Jan. 3, 2006

(54) RETURNABLE CASE

(75) Inventors: Kiyoshi Kasuya, Saitama-ken (JP); Hideo Kojima, Saitama-ken (JP)

(73) Assignee: Komyo Co., Ltd., Saitama-ken (JP)

( * ) Notice: Subject to any disclaimer, the term of this patent is extended or adjusted under 35 U.S.C. 154(b) by 189 days.

(21) Appl. No.: 10/435,726

(22) Filed: May 8, 2003

(65) Prior Publication Data

US 2003/0213726 A1 Nov. 20, 2003

(30) Foreign Application Priority Data

May 15, 2002 (JP) ..... 2002-140286

(51) Int. Cl.

| | |
|---|---|
| ***B65D 6/12*** | (2006.01) |
| ***B65D 6/16*** | (2006.01) |
| ***B65D 6/28*** | (2006.01) |
| ***B65D 8/14*** | (2006.01) |

(52) U.S. Cl. ..... 220/6; 220/7; 220/4.28

(58) Field of Classification Search ..... 220/1.5, 220/6, 7, 4.28; 206/503, 509, 511, 512; 292/DIG. 29, 292/32, 41, DIG. 11, DIG. 42, 33, 42, 137, 292/162, 302; 16/111.1, 404

See application file for complete search history.

(56) References Cited

U.S. PATENT DOCUMENTS

| | | | | |
|---|---|---|---|---|
| 3,917,103 | A * | 11/1975 | Beretta | 220/6 |
| 3,981,410 | A * | 9/1976 | Schurch | 220/6 |
| 4,020,967 | A * | 5/1977 | Hammond et al. | 220/6 |
| 4,186,841 | A * | 2/1980 | Buckley et al. | 220/6 |
| 4,662,532 | A * | 5/1987 | Anderson et al. | 220/7 |
| 4,715,508 | A * | 12/1987 | Schurch | 220/7 |
| 4,775,069 | A * | 10/1988 | Stonier | 220/6 |
| 5,462,188 | A * | 10/1995 | Yurgevich | 220/1.5 |
| 6,691,885 | B2 * | 2/2004 | Brown | 220/7 |

FOREIGN PATENT DOCUMENTS

| | | |
|---|---|---|
| DE | 3633348 A1 * | 4/1988 |
| JP | 9-39954 | 2/1997 |

* cited by examiner

*Primary Examiner*—Nathan J. Newhouse
*Assistant Examiner*—Harry A. Grosso
(74) *Attorney, Agent, or Firm*—Weingarten, Schurgin, Gagenbin & Lebovici LLP

(57) ABSTRACT

The present invention concerns a returnable case comprising a bottom member 1, left and right side members 2L, 2R and front and back side members 3F, 3B, wherein the front and back side members 3F, 3B are formed foldable inward in a two fold state to the bottom member 1 and, in addition, formed to be detachable. A pair of claw insertion openings 1*f* are provided on the bottom member 1, and the width (breadth) thereof is formed wide, and at the same time, the lower part of the member forming the claw insertion opening 1*f* is opened. Thereby, it can be loaded not only by the fork lift but also by the hand lift. The left and right side members 2L, 2R and front and back side members 3F, 3B are joined by a lock member 4.

4 Claims, 10 Drawing Sheets

(a)

(b)

RETURNABLE CASE

BACKGROUND OF THE INVENTION

1. Field of the Invention

The present invention concerns a returnable case enabling a repeated use thereof by assembling before transport of baggage and folding and returning in a folding state after transport.

2. Detailed Description of the Prior Art

As for the aforementioned returnable case, those of various forms are known conventionally, and for example, an earlier application by the present applicant has already been published as Japanese Patent Laid-Open No. 1997-39954. This already published returnable case is composed of, as shown in FIG. 18(*a*), a bottom member 1, left and right side members 2L, 2R and front and back side members 3F, 3B. There, the left and right side members 2L, 2R are composed to rotate by taking the lower end as a fulcrum in regard to the bottom member 1 and to be foldable inward after transport, while the front and back side members 3F, 3B are formed detachably in regard to the bottom member 1. Moreover, the left and right side members 2L, 2R and the front and back side members 3F, 3B are so composed that the junction ends can be joined by a lock member 4.

The returnable case can be easily assembled without using bolt or other latches before transport, easily folded after transport, and further can carry safely baggage therein, and therefore, is extremely easy to handle.

However, the aforementioned returnable case has provoked several problems as mentioned below.

(1) The front and back side members 3F, 3B are formed foldable in two by a hinge taking the longitudinal direction as a boundary, and they can be detached from the bottom member 1 during the disassembling and juxtaposed on the bottom member 1 in a two-folded state, in front and behind however, it is easier to handle by adopting a structure where they can fold as being in the two-folded state without detaching at this moment.

(2) The bottom member 1 is provided with a pair of claw insertion openings 1*f* for inserting the claw of a fork lift, which can be handle with the fork lift, but inhibiting to handle with a hand lift because the claw spacing of the hand lift is shorter than the claw spacing of the fork lift.

(3) The lock member 4 is provided with a lock pin 4*a* moving between a locking position P and an unlocking position Q, and a fitting portion 4*c* of substantially C-shape in cross-section attached to a tip portion of a fitting 4*b* holding the lock pin 4*a*, and has a structure for fitting a vertical frame member 2*b* of the left and right side members 2L, 2R into the fitting portion 4*c*, and locking by inserting the lock pin 4*a* through a hole provided in the vertical frame member 2*b*, as shown in FIG. 18(*b*) however, the lock pin 4*a* tends to come off the locking position P due to the vibration applied during transport. Also, during the disassembling, the fitting portion 4*c* interferes because it protrudes outward from the front and back side members 3F, 3B, or comes in contact with other members to be deformed or damaged, and the tendency to damage the other members, or other situations happens.

(4) A bracket 5 having a C-shape in cross-section for pivotally supporting the vertical frame member of the left and right side members 2L, 2R is erected at four corners of the bottom member 1 and an upper end of the bracket 5 projects upward in case where the front and back side members 3F, 3B and the left and right side members 2L, 2R are folded and stacked on the bottom member 1 during the disassembling. A plurality of disassembled returnable cases are stacked up by inserting a projection portion of the bracket 5 into a recess (part encircled by a vertical frame member 1*a*, a horizontal frame member 1*b* and a reinforcement fitting 14 having an L-shape in cross-section) on the bottom member lower face side of the other disassembled and folded returnable cases. Then, they are moved by a fork lift in the stacked-up state, but a space is generated among returnable cases at this moment, provoking a problem that returnable cases deform easily into a substantial chevron.

SUMMARY OF THE INVENTION

In view of problems of such a conventional returnable case, the inventor has studied diligently, devised means for solving the aforementioned (1) to (4) and came to achieve the present invention. There, the present invention has an object to provide a returnable case wherein the front and back side members 3F, 3B can fold in two without detaching from the bottom member 1 during the disassembling, the handling baggage can be executed not only by a fork lift but also by a hand lift, the lock member 4 is improved to prevent unlocking even when vibration is applied during the transport and, at the same time, the fitting portion 4*c* projecting from the tip is disused for avoiding interference, and a deformation into a chevron does not occur when returned, stacked up and lifted by a fork lift.

As a means for achieving the aforementioned object, a returnable case comprising a bottom member, left and right side members provided foldable inward in regard to the bottom member, and front and back side members detachable in regard to the bottom member and formed two-foldable taking the longitudinal direction as a boundary, in which contact ends of the left and right side members and the front and back side members are disposed enabling to lock and unlock by a lock member, wherein the front and back side members are formed foldable inward by pivotally supporting respective lower ends with the bottom member. Whereby, it can fold inward in a two-folded state, without detaching the front and back side members from the bottom member during the disassembling.

Another means for achieving the aforementioned object is characterized by that the bottom member has a pair of claw insertion openings, the claw insertion openings are set to a size capable of inserting any of claw of the fork lift or claw of the hand lift, and at the same time, under parts of a member forming the claw insertion openings are open respectively. Whereby, since the claw insertion opening of the bottom member is made as combined type for insertion of both claws of the fork lift or hand lift, either of them capable used for handling baggage. In addition, a roller disposed at the tip portion of the claw of a fork lift can be earthed, because the lower part of the member forming the claw insertion opening is open.

Another means for achieving the aforementioned object is characterized by that the front and back side members have a pair of engagement bars attached to the lower end, and when the engagement bars are fitted to a pair of supporting reception members provided on the bottom member, the front and back side members can rotate by taking the supporting reception members as a fulcrum, and when the engagement bars are removed from the supporting reception member, the front and back side members can be extracted from the bottom member. Thereby, the front and back side members can be not only folded inward to the bottom member, but also can be removed from the bottom member.

Another means for achieving the aforementioned object is characterized by that for the pair of engagement bars attached to the lower ends of the front and back side members, the length of any one of engagement bars is set shorter than the length of the other engagement bar. Whereby, when the front and back side members are attached to or detached from the bottom member, the attachment and detachment operation can be executed easily.

Another means for achieving the aforementioned object is characterized by that the lock member has a slide bar attached to the end of the front and back side members through a retention member, and a bent portion disposed at the tip of the slide bar, the rock member is formed to lock by passing the bent portion through an engagement long hole disposed on the vertical frame member of the left and right side members and, at the same time, axially rotating the slide bar by 90 degrees, and to unlock by axially rotating the slide bar by 90 degrees in the opposite direction from the locked state and extracting the same from the long hole. Whereby, the fitting portion in the conventional lock member can be abolished.

Another means for achieving the aforementioned object is characterized by that the retention member is provided with a fixation portion to which the spring action is afforded and the slide bar is formed enabling to fit or to detach from the fixation portion. Whereby, when locked, the slide bar is fixed to the fixation portion, and the slide bar seldom comes off even when vibrations are applied during transport.

Another means for achieving the aforementioned object is characterized by that the vertical frame member of the front and back side members is provided with a space for containing the tip bent portion of the slide bar when the lock member is unlocked between vertical frame members of the left and right side members and the same. Whereby, the tip bent portion of the slide bar does not project outward from the left and right side members when unlocked, nor interfere with the inward folding of the front and back side members.

Another means for achieving the aforementioned object is characterized by that the bottom member has pivotal support members for pivotally supporting the vertical frame member of the left and right side members, erected at four corners thereof, the upper end of the pivotal support member projects upward from the upper end face when the front and back side members and the left and right side members are folded and stacked up, and the quantity of the projection corresponds with the depth of a fitting recess provided in the lower face side four corners of the bottom member during the stacking-up of the other folded returnable cases. Whereby, if folded returnable cases are stacked up, a space will not be created between upper and lower returnable cases, and they will not deform into chevron even when lifted by a fork lift.

Another means for achieving the aforementioned object is characterized by that, in the fitting recess, a protection plate for closing the opening end of the frame member forming the bottom member is mounted in a slant state toward over the recess. Whereby, when the upper end projection portion of the pivotal support member is to be inserted into the recess during the stacking-up, the opening end of the frame member is protected by the protection plate, and the protection plate serves as guide, facilitating the insertion of the upper end projection portion of the pivotal support member.

Another means for achieving the aforementioned object is characterized by that the bottom member has a pair of claw insertion openings respectively on the front side, back side and both sides and these claw insertion openings are set to a size capable of inserting both claws of the fork lift or the hand lift. Whereby, the claw of the fork lift or the hand lift from any direction (four directions) when the returnable case is handled baggage, can be secured the convenience and the workability of handling baggage.

Another means for achieving the aforementioned object is characterized by a composition wherein a wheel can be mounted detachably, for a corner fitting fixed to the outside of an edge corner of the bottom member. Whereby, the operator can move the returnable case easily by the hand permitting to secure still more the convenience and the workability of handling baggage.

Another means for achieving the aforementioned object is characterized by that a hole is formed on the corner fitting fixed to the outside of the edge corner of the bottom member and a colored insertion portion is installed at the upper end of the vertical frame member for the left and right side members, allowing to view the colored insertion portion from the exterior through the hole, when returnable cases are stacked up with the insertion portion inserted in the corner fitting. Whereby, the safety of returnable cases during the stacking-up can be secured, by ascertaining if they are stacked up normally.

Another means for achieving the aforementioned object is characterized by that the retention member is provided with a vertical substrate and bent pieces erected at both ends thereof, a socket made of silicon rubber is fixed to the lower part of the vertical substrate, a fixing portion of the slide bar is composed of the socket and the bent piece, and the slide bar is formed to be able to fit or detach the slide bar to or from the fixing portion. Whereby, the impact can be absorbed and followed by the silicon rubber socket even if an external force such as impact is applied during transport, permitting to prevent the fixing portion from deforming and the lock function from being deteriorated.

BRIEF DESCRIPTION OF THE DRAWINGS

These and other objects and advantages of the present invention will become clear from the following description with reference to the accompanying drawings, wherein:

FIG. 7(*a*) is an enlarged plan view of the left engagement bar and (*b*) is an enlarged plan view of the right engagement bar;

DETAILED DESCRIPTION OF THE PREFERRED EMBODIMENTS

Next, embodiments of a returnable case according to the present invention shall be described based on attached drawings. In the description of the present embodiment, members corresponding to the aforementioned returnable case shall be referenced with the same symbols.

Figure 1:
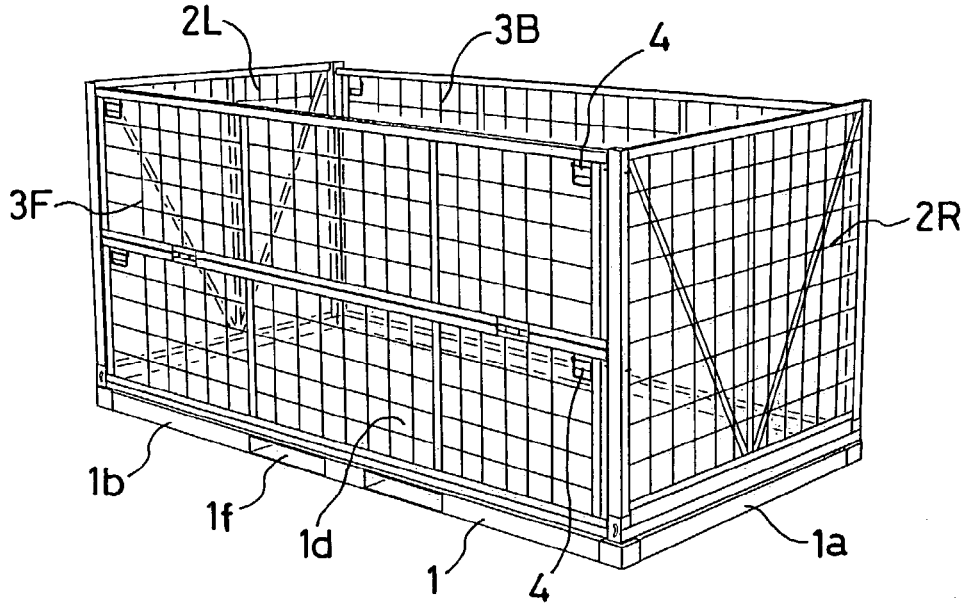
FIG. 1 is a general outline view showing an embodiment of a returnable case according to the present invention.

FIG. 1 is a general outline view of a metallic returnable case according to the present invention, comprising a bottom member 1, left and right side members 2L, 2R pivotally supported with the bottom member 1 at the lower part and formed to be foldable inward, and front and back side members 3F, 3B formed to be foldable in two by taking the longitudinal direction as a boundary, detachable to the bottom member 1 and also pivotally supported by the bottom member 1 at the lower part and formed to be foldable inward. The left and right side members 2L, 2R and the front and back side members 3F, 3B have a structure joined by a lock member 4 at the junction ends.

The aforementioned bottom member 1 is composed by forming a base from vertical frame members 1*a* and horizontal frame members 1*b* formed of a square pipe and a plurality of staves 1*c* (FIG. 2) longitudinally put across and fixed, and at the same time, laying an iron plate 1*d* on the base.

Figure 2:
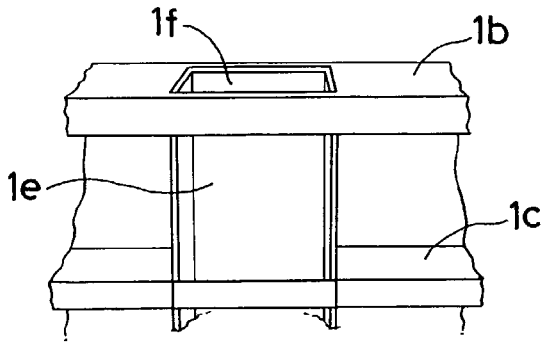
FIG. 2 is a partial perspective view of a bottom member of the returnable case according to the embodiment of the present invention viewed from the bottom face side.

FIG. 2 is a partial perspective view of the bottom member 1 viewed from the bottom face side, wherein a vertical rung le having a substantially C-shape in cross-section is put across and fixed to the horizontal frame member 1*b*, and both ends thereof are made as claw insertion openings 1*f* of the fork lift or hand lift. In this case, the vertical rung le is opened downward except for a portion orthogonal to the stave 1*c*, and a plate is welded to the orthogonal portion to reinforce the stave 1*c*.

Figure 3:
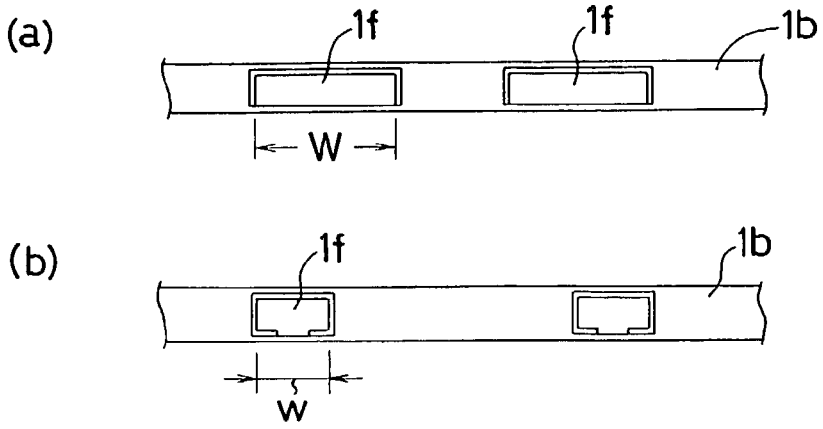
FIG. 3(*a*) is a schematic drawing of a claw insertion opening of the returnable case according to the embodiment of the present invention viewed from the front side and (*b*) is a schematic drawing of a claw insertion opening of a conventional returnable case viewed from the front side.
Figure 4:
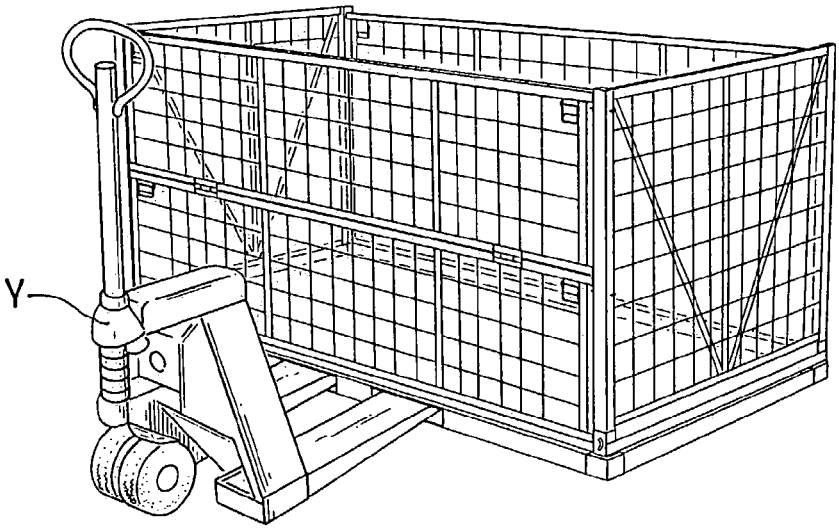
FIG. 4 is an outline view in case where the returnable case according to the embodiment of the present invention is handling baggage by a hand lift.

FIG. 3(*a*) shows claw insertion openings 1*f* viewed from the front side, a pair of claw insertion openings if is provided on the horizontal frame member 1*b* of the bottom member 1, and the width W (breadth) of each claw insertion opening 1*f* is formed larger than the width w of the claw insertion opening 1*f* (w<W). Moreover, the width opening downward is made larger than that of the prior art as the mentioned above by changing the cross-section shape of the vertical rung le from the conventional one. Consequently, in case of the present invention, not only the claw of a fork lift can be inserted into the claw insertion opening 1*f*, but also the claw of a hand lift Y narrower than the claw spacing of the fork lift as shown in FIG. 4. Moreover, though a roller, not shown in drawing, is normally mounted on the tip portion of a claw of a hand lift, in case of the present invention, as the lower part of the vertical rung le is wider and open downward, the roller grounds after the claw insertion allowing to lift by the hand lift Y. In short, the handling baggage can be performed both by the fork lift or hand lift.

Figure 5:
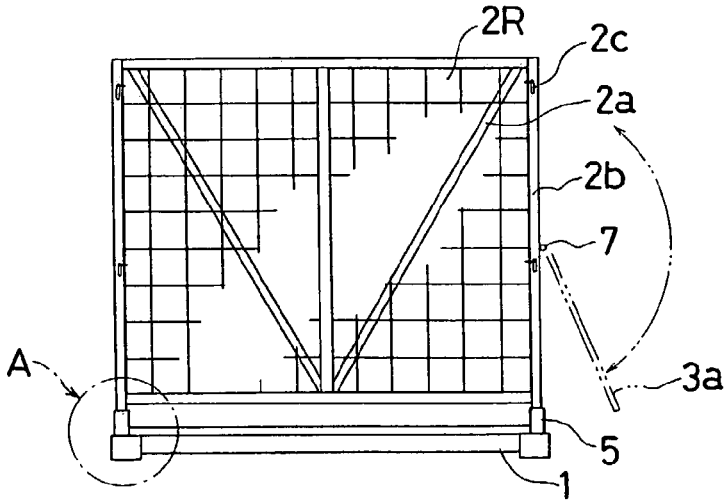
FIG. 5 is a schematic side view of the returnable case according to the embodiment of the present invention.

FIG. 5 is a side view of the returnable case according to the present invention, wherein the right side member 2R (same for the left side member 2L) is formed into a substantial lattice shape with square pipes and round bars, and brace members 2*a* for reinforcement are mounted in a V-shape. It should be noted that the brace member is not limited to the V-shape, but also it is mounted by crossing in an X-shape in some cases.

Figure 6:
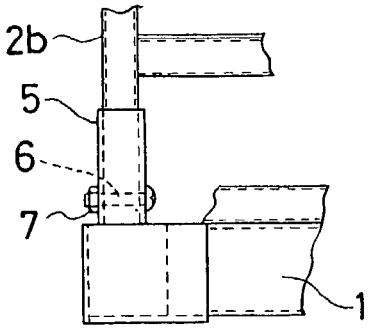
FIG. 6 is a partial cutaway enlarged view of A portion in FIG. 5.

FIG. 6 is a partial cutaway enlarged view of A portion in FIG. 5, the lower end of the vertical frame member 2*b* of the side member 2R is pivotally supported by a bracket-like pivotal support member 5 having a C-shape in cross-section arranged in a standing condition at four corner portions of the bottom member 1 and mounted foldable inwards to the bottom member 1. In short, holes are oppositely provided at the lower end of the vertical frame member 2*b* of the side member 2R, the lower end of the vertical frame member 2*b* is fitted to the pivotal support member 5, a shaft bar 6 inserts through one of guide holes 5*a* (FIG. 17) oppositely provided in the pivotal support member 5, and a nut 7 is tighten to the tip screw portion thereof. Thereby, when the side member 2R is lifted, the shaft bar 6 rises along the vertical portion of the guide hole 5*a* and, then, when the side member 2R is pushed down inward and the shaft bar 6 is moved along the slant portion of the guide hole 5*a*, the side member 2R can rotate by taking the shaft bar 6 as a fulcrum and fold on the bottom member 1. It should be noted that the pivotal support structure is not limited to the shaft bar 6 and the nut 7, but also it can be composed of a rivet-like pin and a split pin.

Besides, contrary to this, the vertical frame member 2*b* fits into the pivotal support member 5 if the side member 2R is pushed up from the folded state and rotated outward, and the shaft bar 6 is moved from the slant portion to the vertical portion of the guide hole 5*a*, allowing to return the side member 2R to the upright state.

Figure 7:
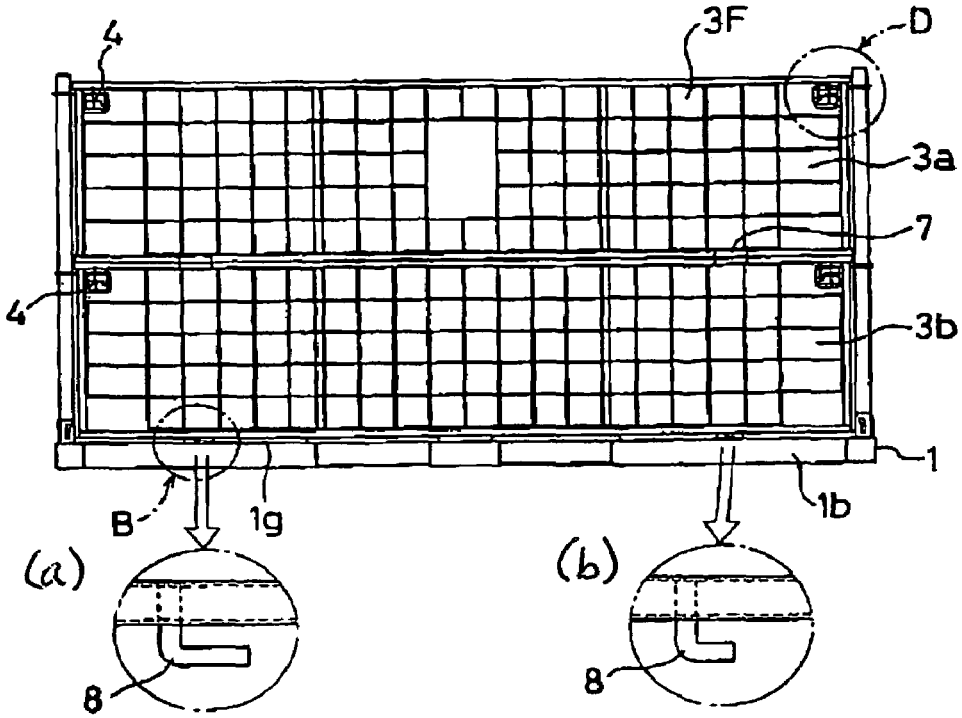
FIG. 7 is a schematic front view of the returnable case according to the embodiment of the present invention.

FIG. 7 is a front view of the returnable case according to the present invention, the front side member 3F (same for the back side member 3B) is formed into a substantial lattice shape with square pipes and round bars, an upper half 3*a* and a lower half 3*b* are linked with two hinges 7, and the upper half 3*a* can rotate outward and fold through the hinge 7. Namely, the side member 3F can fold in two taking the longitudinal direction as a boundary.

Besides, the lower member 3*b* is supported rotatably to the bottom member 1, and is also detachable. Two L type engagement bars 8 protrude in the same direction at the lower end of the lower member 3*b* near left and right emds as shown by the partial enlarged view in FIG. 7. The supporting reception members 10 (FIG. 8) corresponding to these engagement bars 8 are provided on the bottom member 1.

Figure 8:
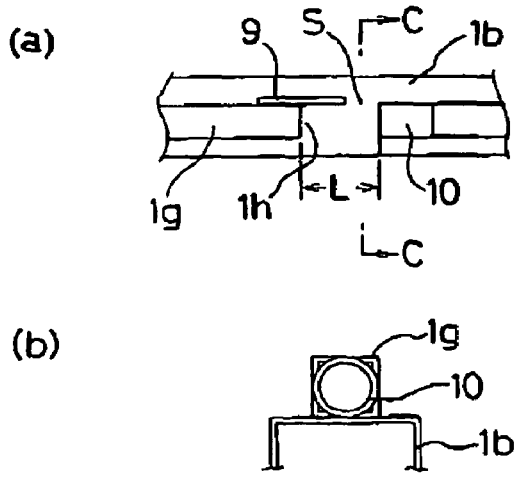
FIG. 8(*a*) is an enlarged plan view of B portion in FIG. 7 and (*b*) is a schematic sectional view taken along line C—C thereof.

FIG. 8(*a*) is an enlarged plan view of B portion in FIG. 7, a part of an auxiliary stave 1*g* fixed on the stave 1*b* of the bottom member 1 is notched by a predetermined length, a flat plate member 9 is fixed to the side face of the auxiliary stave 1*g* so as to cover approximately the half of the length of the notch portion 1*h* at one (left side) end of the notch portion 1*h*, while a cylindrical supporting reception member 10 where the engagement bar 8 can be inserted as shown in FIG. 8(*b*) is fixed to the other (right side) end of the notch portion 1*h*. There, the distance L between the left end face of the notch portion 1*h* and the tip face of the supporting reception member 10 is set equal or slightly superior to the length of the horizontal portion of the engagement bar 8. Also, among left and right engagement bars 8, the horizontal portion length of the right engagement bar is set slightly shorter than the left engagement bar.

Therefore, if the engagement bar 8 of the side member 3F is fitted from forward in a way to meet the notch portion 1*h* of the bottom member 1, applied to the flat plate member 9 and held in this state to slide the side member 3F to the right, the engagement bar 8 will fit into the supporting reception member 10, thereby, allowing to fit the side member 3F to the bottom member 1. During this fitting, the fitting operation can be facilitated because the length of the horizontal portion is different for the left and right engagement bars 8 as mentioned above and the right engagement bar is slightly shorter.

Thus, after mounting the side member 3F on the bottom member 1, the side member 3F can rotate through the engagement bar 8 by taking the supporting reception member 10 as a fulcrum, and as mentioned above, the side member 3F can fold on the bottom member 1 in the two-folded state. At this time, the vertical portion of the engagement bar 8 is contained in a space S between the flat plate member 9 and the supporting reception member 10.

Beside, contrary to this, the side member 3F can be removed from the bottom member 1, if the side member 3F is pushed up from the folded state by rotating outward, and slid to the left to extract the engagement bar 8 from the supporting reception member 10. The side member 3F has been made detachable in order to facilitate the handling baggage of the returnable case mentioned below.

A lock member 4 is attached respectively to both ends of the upper part of the upper half 3*a* and the upper part of the lower half 3*b* in the side member 3F. As these four lock members 4 are of the same composition, one of them, for example, the lock member 4 of the upper right side of the upper half 3*a* shall be described.

Figure 9:
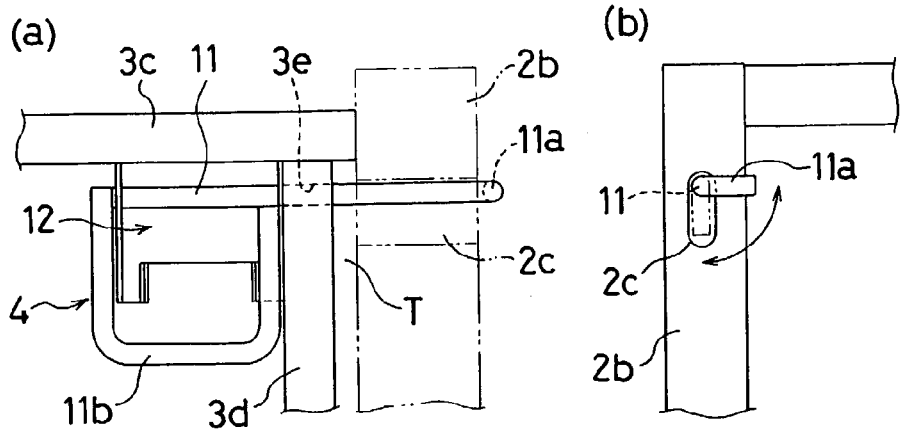
FIG. 9(*a*) is a schematic enlarged view of D portion in FIG. 7 and (*b*) is a schematic side view thereof.

FIG. 9(*a*) is a schematic enlarged view of D portion in FIG. 7, the lock member 4 is composed of a slide bar 11 and a retention member 12 for holding the slide bar 11, a bent portion 11*a* is provided at the tip of the slide bar 11, the bent portion 11*a* paths through an engagement long hole 2*c* disposed on the vertical frame member 2*b* in the left and right side members (right side member 2R in the drawing) and, at the same time, the slide bar 11 rotates axially by 90 degrees to lock, and the slide bar 11 is axially rotated by 90 degrees in the opposite direction from the lock state to adjust to the long hole 2*c* and extracted to unlock.

Also, a U-shape handle 11*b* is attached to the base to the slide bar 11, the handle 11*b* facilitate the sliding and axial rotation operation of the slide bar 11, the engagement of the handle 11*b* and the retention member 12 restricts the position of the slide bar 11 and, at the same time, permits to hold securely the slide bar 11 at the lock position or unlock position.

The aforementioned retention member 12 is fixed to an upper frame member 3*c* (more precisely, upper frame member of the upper half 3*a*) of the side member 3F, provided with a vertical substrate 12*a* and bent pieces 12*b* erected at both ends thereof, through holes 12*c* are disposed oppositely on the bent piece 12 to pass through the slide bar 11, the lower part of the vertical substrate 12*a* is notched, and a fixing portion 12*e* having a substantially C-shape in cross-section is disposed oppositely by erecting both ends of the notch portion 12*d* in a curved shape for affording an elastic force. The handle 11*b* of the slide bar 11 can be fitted to or detached from the fixing portion 12*e*. FIG. 9(*a*) shows a state where the handle 11*b* is fixed by fitting to the right side fixing portion 12*e*, for holding the locked state.

On the other hand, if the handle 11*b* is pulled to near side, the handle 11*b* comes off the fixing portion 12*e* of the retention member 12 and, following above, if the handle 11*b* is rotated by 90 degrees upward, the tip bent portion 11*a* of the slid bar 11 turns to a position by the virtual line in FIG. 9(*b*). If the handle 11*b* is moved further to the left from the state, the bent portion 11*a* of the slide bar 11 will pass through the long hole 2*c* of the side member 2R and be extracted, resulting in unlocking. After unlocking, if the handle 11*b* is rotated by 90 degrees downward, and pushed into the left side fixing portion 12*e* this time, the handle 11*b* will be fitted and fixed. At this time, as a vertical frame member 3*d* (more precisely, vertical frame member of the upper half 3*a*) of the side member 3F side is provided with a space T for containing the tip bent portion 11*a* of the slid bar 11 between the vertical frame member 2*b* of the side member 2R side and the same, the rotation operation of the handle 11*b* can be executed securely and, moreover, the tip bent portion 11*a* does not project outward from the side member 3F, nor interfere with inward folding of the side member 3F. It should be noted that the vertical frame member 3*d* of the side member 3F side is provided with a through hole 3*e* to insert through the slide bar 11.

Figure 11:
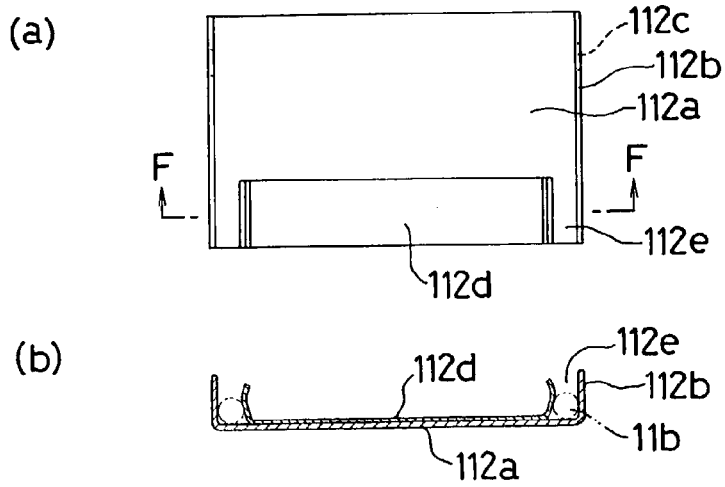
FIG. 11(*a*) is a front view showing another embodiment of the retention member and (*b*) is a sectional view taken along line F—F thereof.

FIG. 11 is another embodiment of the retention member and, in the composition of this case, the lower part of the vertical substrate 112*a* is not notched as in FIGS. 11(*a*), (*b*), but a fixing portion 112*e* having a substantially C-shape in cross-section is disposed oppositely by attaching a band plate member 112*d*, erected both ends thereof in a curved shape for affording an elastic force. The handle 11*b* of the slide bar 11 can be fitted to or detached from the fixing portion 112*e*. It should be noted that the bent piece 112*b* at both ends of the vertical substrate 112*a* is provided with a through hole 112*c* to pass through the slide bar 11.

The front and back side members 3F, 3B can be linked to the left and right side members 2L, 2R through the lock member 4 as mentioned above, and the front side member 3F is removed when the returnable case is loaded with baggage. In short, three peripheral sides of the bottom member 1 is surrounded by the bottom member 1, left and right side members 2L, 2R and back side member 3B, and the baggage can be placed easily in this state. After loading, the front side member 3F is attached to the bottom member 1 as mentioned before, and the left and right side members 2L, 2R are linked with the lock members 4 to put the returnable case into the complete shape. Then, the returnable case after loading can be moved, or transported into a container and so on by a fork lift or hand lift using the claw insertion opening 1*f* of the aforementioned bottom member 1.

Now, the folding operation on the baggage reception side of the returnable case shall be described. On the baggage reception side, normally the lock member 4 in the front side member 3F is unlocked and, at the same time, removed from the bottom member 1 to open the front of the returnable case for unloading.

Figure 12:
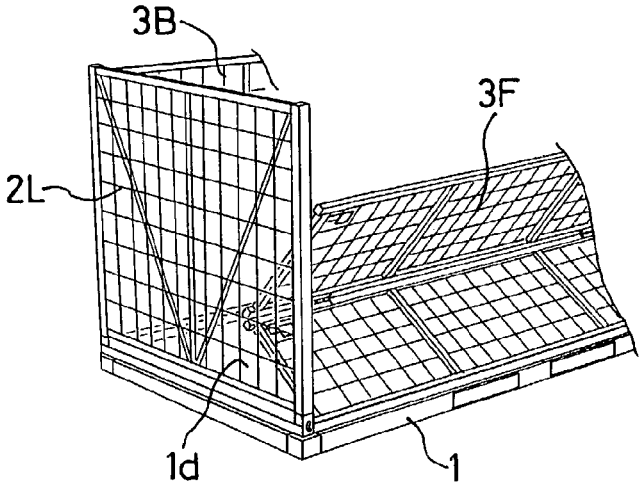
FIG. 12 is an outline view showing how the front side member of the returnable case according to the embodiment of the present invention folds in two inward.

Thereafter, the front side member 3F is attached to the bottom member 1 for the empty returnable case, the front side member 3F is folded inward in two as shown in FIG. 12 and placed on the iron plate 1*d* of the bottom member 1. Moreover following the above, the behind side member 3B is folded inward in two folded state as same as the front side member 3F, and placed on the iron plate 1*d* of the bottom member 1, while unlocking the lock member 4. Thereby, two back side members 3F, 3B can be juxtaposed on the iron plate 1*d* of the bottom member 1 front and behind.

Figure 13:
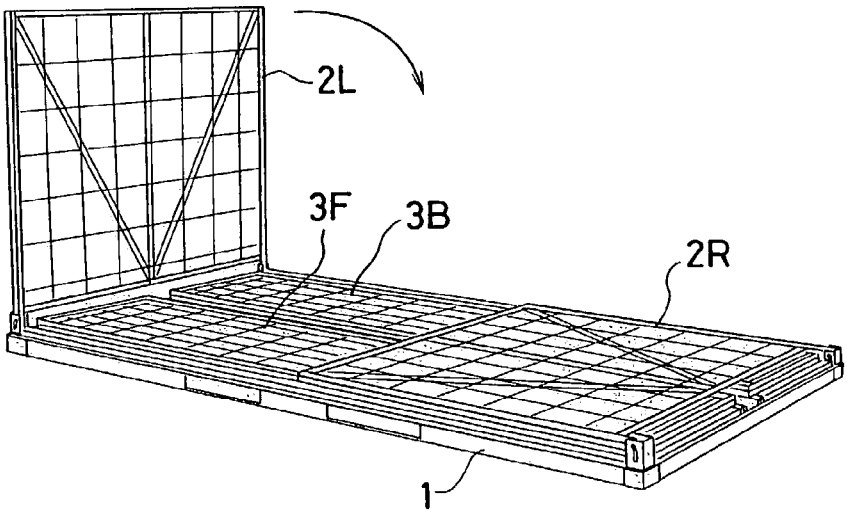
FIG. 13 is an outline view showing how the left and right side members of the returnable case according to the embodiment of the present invention fold inward.
Figure 14:
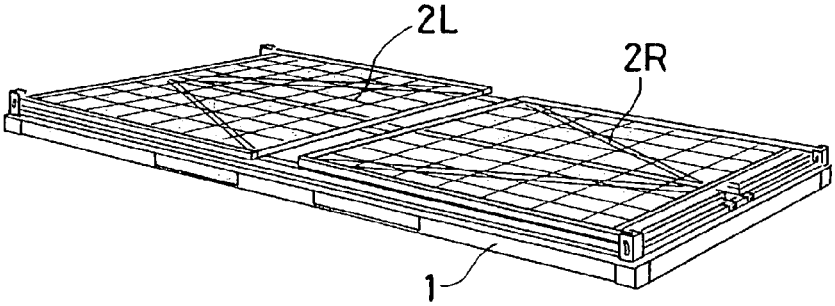
FIG. 14 is an outline view showing the returnable case according to the embodiment of the present invention in a folded state.

After folding the front and back side members 3F, 3B, the left and right side members 2L, 2R are folded inward like as shown in FIG. 13 and placed on the front and back side members 3F, 3B. Thereby, the returnable case can fold substantially flat as shown in FIG. 14.

Figure 15:
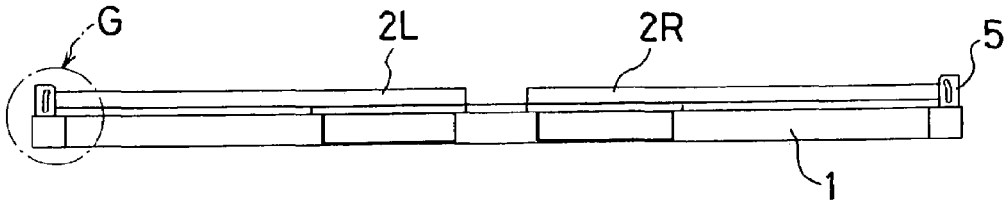
FIG. 15 is a front view showing the returnable case according to the embodiment of the present invention in a folded state.
Figure 17:
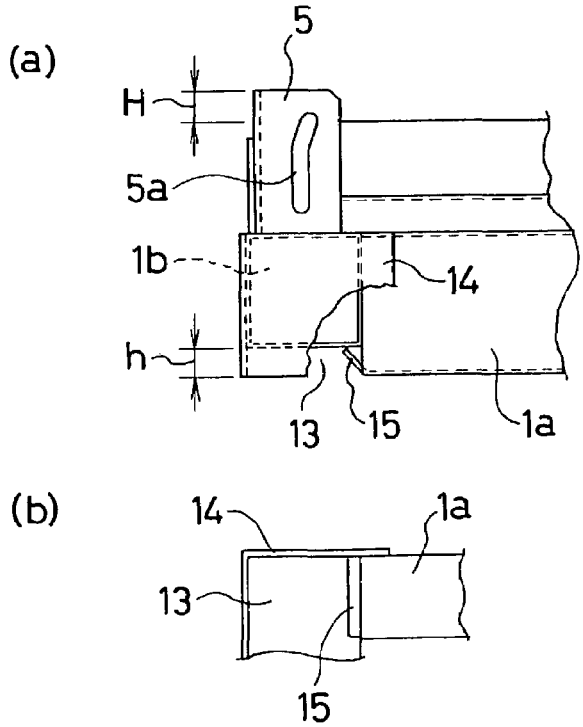
FIG. 17(*a*) is a partial cutaway schematic enlarged view of G portion in FIG. 15 and (*b*) is a bottom face view thereof.
Figure 18:
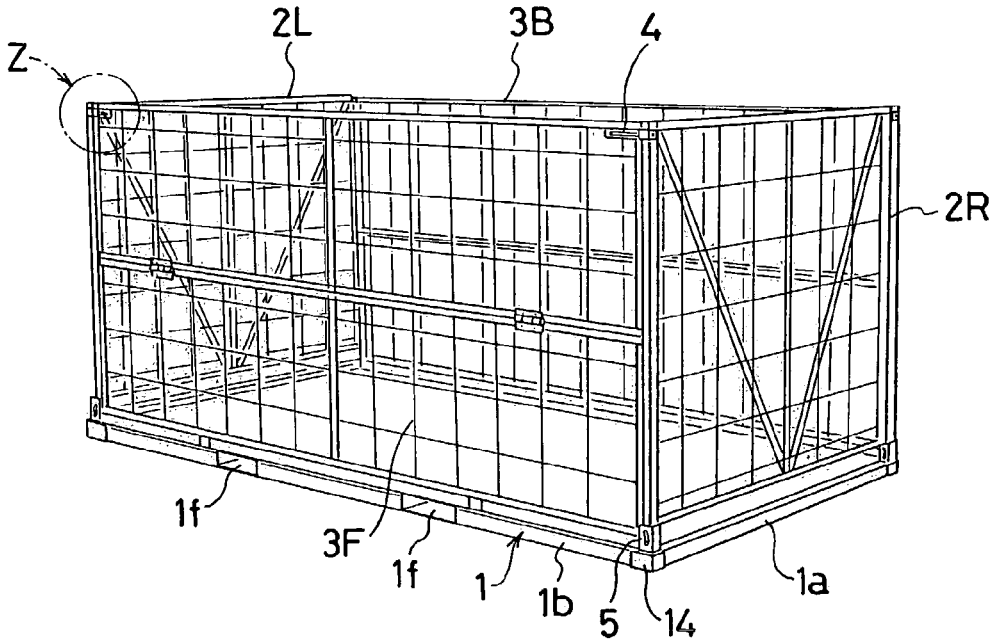
FIG. 18 shows a conventional returnable case, (*a*) is an outline view of the whole, (*b*) a schematic enlarged view of Z portion thereof.
Figure 18:
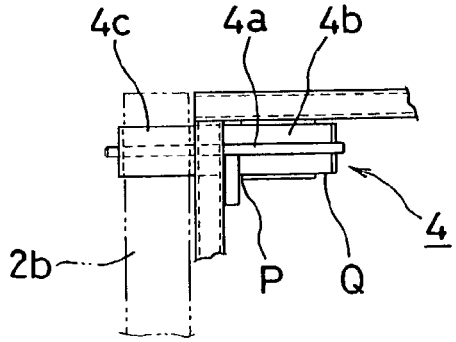

When the returnable case folds substantially flat, the upper end of the bracket like pivotal support member 5 arranged in a standing condition at four corner portions of the bottom member 1 as shown in FIG. 15 projects from the top face of the folded left and right side members 2L, 2R by a predetermined height H like as shown in FIG. 17(*a*).

Figure 16:
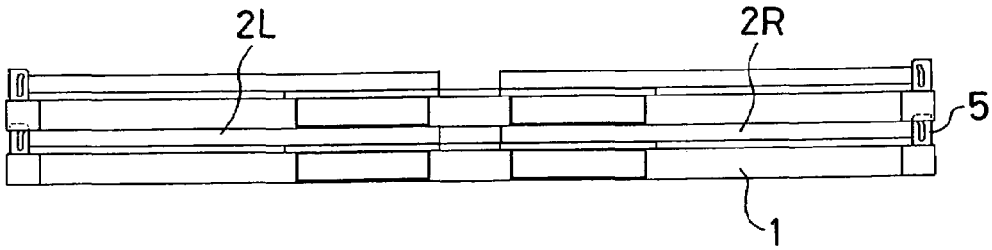
FIG. 16 is a front view showing a state where the folded returnable cases according to the embodiment of the present invention are stacked in two layers.

The pivotal support member 5 projects for piling up folded returnable cases in a plurality of layers and a recess for fitting in the upper end of the pivotal support member 5 is provided on the lower face side of the four corner portions of the bottom member 1. In short, the recess 13 is formed by the vertical frame member 1*a* and the horizontal frame member 1*b* of the bottom member 1, and a reinforcement fitting 14 having a L-shape in cross-section attached to the edge corner portion of the bottom member 1 as shown in FIG. 17(*a*) and FIG. 17(*b*), view thereof from the lower face side. In this case, the vertical frame member 1*b* is set lower than the horizontal frame member 1*a* in height, and the reduced height portion is surrounded by the reinforcement fitting 14 to form the recess 13, and further, the depth h (difference of height) of the recess 13 is set equal to the projection height H of the pivotal support member 5 (h=H). Consequently, when the folded returnable cases are staked up like as FIG. 16, if the projected upper end of the pivotal support member 5 is fitted in the recess 13 of the bottom member 1, a space will not appear between upper and lower returnable cases. Thereby, returnable cases can be prevented beforehand from deforming into chevron, when they are stacked up in a plurality of layers (normally equal or superior to 10 layers), loaded and unloaded by a fork lift and so on.

Also, as the aforementioned vertical frame member 1*b* is set lower than the horizontal frame member 1*a* in height, the open lower end of the horizontal frame member 1*a* is exposed in the recess 13, and a protection plate 15 for obstructing the open lower end is attached to the horizontal frame member 1*a* in a slant state toward the above of the recess 13. Thereby, when the projected end of the pivotal support member 5 is fitted, the protection plate 15 acts as guide and facilitates the insertion into the recess 13 and at the same time prevents the lower end of the horizontal frame member 1*a* from being damaged, deformed and so on.

In this way, the returnable case is returned to the consignment side in a stacked state. The returned returnable case is reassembled and recycled. When the returnable case is assembled, the left and right side members 2L, 2R are erected by rotating outward, the front and back side members 3F, 3B are also rotated outward, the upper half 3*a* an the lower half 3*b* are reset flush, and linked to the left and right side members 2L, 2R by the lock member 4, to facilitate the assembly. When loading the assembled returnable case with baggage, only the front side member 3F is removed from the bottom member 1. It should be noted that, in such a case that the returnable case is loaded with baggage by a crane or the like from the upper opening, sometimes it is unnecessary to remove the front side member 3F.

Besides, though the side member was the one formed substantially in a lattice form, in the returnable case of the aforementioned embodiment, it is not limited to this, but, for example, even a side member covered with a panel can be executed, and, though the bottom member was the one where an iron plate was laid, it is not limited to this, but even a bottom member formed, for example, substantially in a lattice form can be executed.

Figure 19:
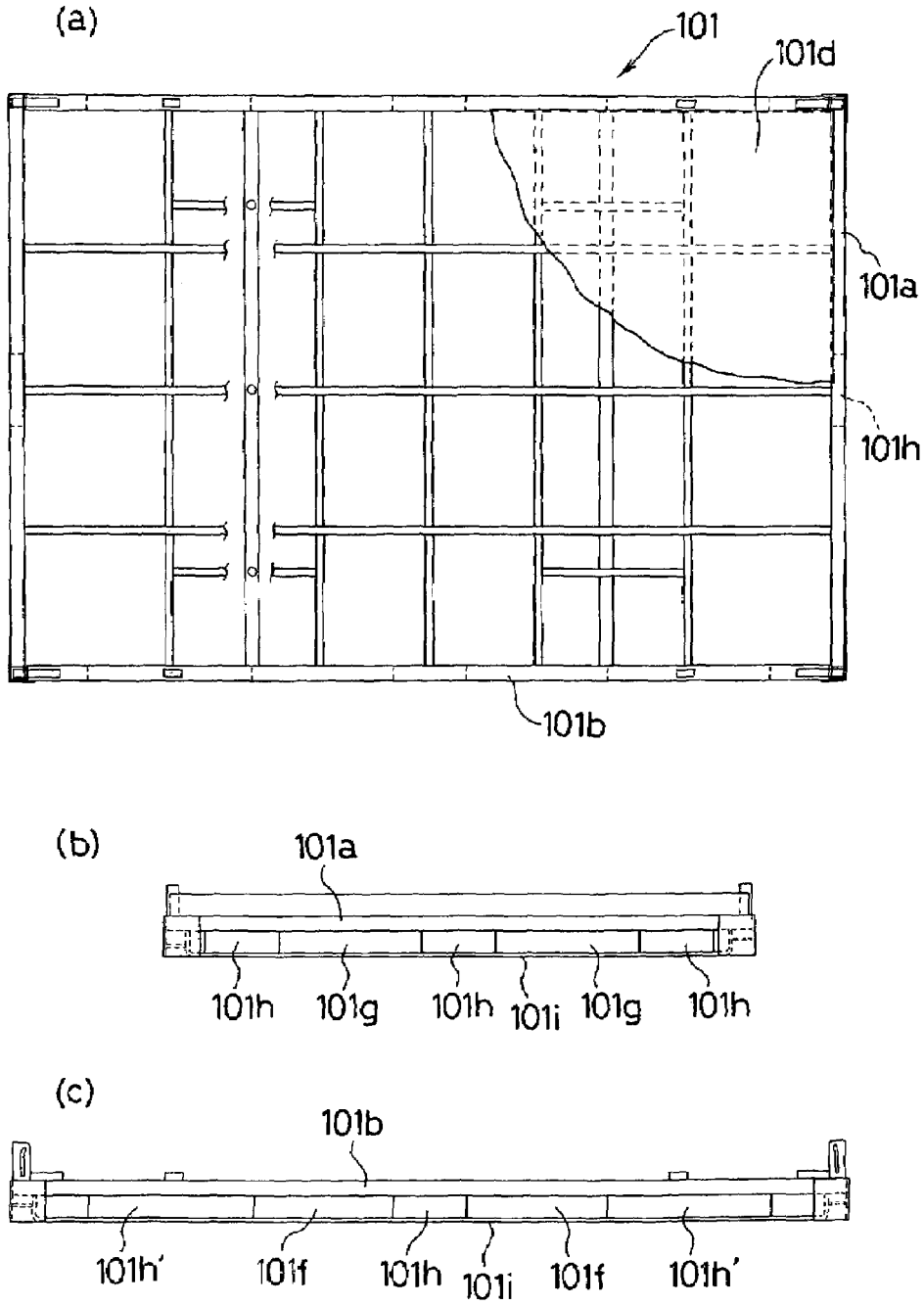
FIG. 19 shows an embodiment where the structure is developed in order to use in place of a bottom member 1 of FIG. 1, (*a*) is a partial cutaway plan view, (*b*) a side view and (*c*) a front view.

Next, an embodiment wherein the composition of the returnable case according to the present invention was developed shall be described. FIG. 19 shows an embodiment where the structure was developed in order to use in place of the bottom member 1 of FIG. 1, and for the bottom member 101, a frame body is formed with metal pipe, metal pipes are attached vertically and horizontally in the frame body forming a lattice, and a base is composed by laying an iron plate 101*d* on the top face thereof.

A bearer 101*h* having a substantial C-shape in form when viewed from the plan and the same width as the vertical frame member 101*a* is fixed under the vertical frame member 101*a* of the base dividing into the central portion and both ends as in FIG. 19(*b*), and further fixed by attaching a metal plate 101*i* having the same width as the vertical frame member 101*a* under these bearers 101*h*. Whereby, a pair of claw insertion openings 101*g* is composed by a space portion created between the bearer 101*h* of the central portion and the bearer 101*h* of front and back both ends. The other side opposed to the vertical frame member 101*a* also forms similarly a pair of claw insertion openings. These claw insertion openings 101*g* are capable of inserting both the claw of the fork lift or the claw of the hand lift.

Similarly, a bearer 101*h* having a substantial C-shape when viewed from the plan and the same width as the horizontal frame member 101*b* is fixed under the horizontal frame member 101*b* of the aforementioned base dividing into the central portion and both ends as shown in FIG. 19(*c*), and further fixed by attaching a metal plate 101*i* having the same width as the horizontal frame member 101*b* under these bearers 101*h*. In this case, the bearer 101*h*' at left and right end is made longer in dimensions than the 101*h* of the central portion, to reinforce both ends. Whereby, a pair of claw insertion openings 101*f* are composed by a space portion created between the bearer 101*h* of the central portion and the bearer 101*h*' of left and right both ends. The other side opposed to the horizontal frame member 101*b* also forms similarly a pair of claw insertion openings. These claw insertion openings 101*f* are capable of inserting both the claw of the fork lift or the claw of the hand lift.

According to thus formed bottom member 101, there is a claw insertion opening 1*f* on both front side and back side and, in addition, there is a claw insertion opening 101*g* on both left side face side and right side face side, capable of inserting the claw of the fork lift or the claw of the hand lift from any of directions (four direction) during the handling baggage of the returnable case, thereby securing the facility and the workability of handling baggage.

Figure 20:
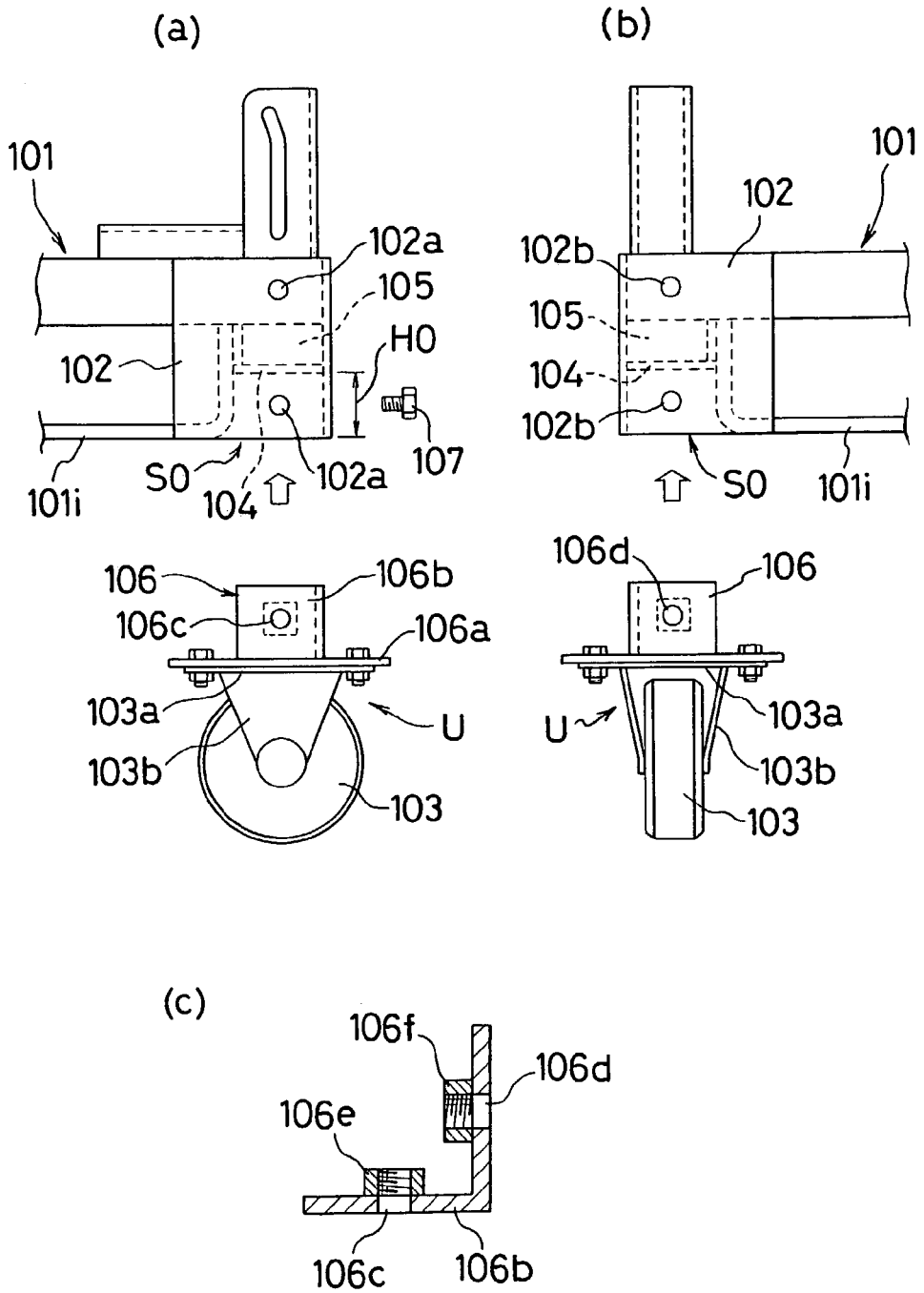
FIG. 20 shows an embodiment so developed that the wheel can be mounted detachably to the returnable case, (*a*) is an essential part front view in a state before mounting the wheel, (*b*) a side view thereof and (*c*) a cross sectional view of an insertion portion.

FIG. 20 shows an embodiment so developed that a wheel can be mounted detachably to the returnable case, and compose to be able to detachably mount a wheel 103 to a corner fitting 102 of substantially L form in the plan shape fixed to the outside of the edge corner of the bottom member 101.

For the aforementioned corner fitting 102, a mounting hole 102*a* is perforated on the front side dividing up and down like as FIG. 20(*a*) and at the same time a mounting hole 102*b* is perforated also on the side face dividing up and down like as FIG. 20(*b*). The upper mounting hole among the front side mounting holes 102*a* and the upper mounting hole among the side face mounting holes 102*b* turn up to be obstructed when the corner fitting 102 is attached to the bottom member 101, in order not to limit the up and down direction during the mounting operation of the corner fitting 102, namely, allow to mount easily without noticing the up and down of the corner fitting 102.

Besides, in a metal plate 101*i* on the front side of the bottom member 1, an end is bent upward as in FIG. 20(*a*) and the bent piece stands inside the corner fitting 102 and an metal plate 101*i* on the side face side is also bent upward in the end as FIG. 20(*b*), and the bent piece stands inside the corner fitting 102. Consequently, a square cylindrical space portion S0 surrounded by the bent piece of two metal plates 101*i* and the L-shape corner metal 102 and open downward is composed. A positioning plate 104 is horizontally fixed to a point at a predetermined distance (height H0) from the bottom face of the corner fitting 102 in the space portion S0, a L-shape reinforcement plate 105 is fixed in a space portion above the positioning plate 104 for stably holding the positioning plate 104, and preventing the deformation.

The wheel 103 is supported by a rotation shaft through a bracket 103*b* fixed to a substrate 103*a*, and an insertion portion 106 to the corner fitting 102 is provided on the top face of the substrate 103*a*. The insertion portion 106 is composed of a horizontal substrate 106*a* and an L-shape mounting plate 106*b* fixed to the top face thereof, the horizontal substrate 106*a* is fixed to the aforementioned substrate 103*a* with bolt and nut, a through hole 106*c* is provided on the front side of the mounting plate 106*b* in a place agreeing with the lower mounting hole 102*a* when the insertion portion 106 is inserted into the corner fitting 102 and brought into contact with the positioning plate 104 and a through hole 106*d* is also provided on the side face side of the mounting plate 106*b* in a place agreeing with the lower mounting hole 102*b*. Further, nuts 106*e*, 106*f* are fixed by welding to the inner face side of the mounting plate 106*b* aligning the central line with the aforementioned through holes 106*c*, 106*d* as in FIG. 20(*c*).

A wheel unit U of such composition can be mounted on the returnable case, by inserting the aforementioned insertion portion 106 into the corner fitting 102 and bringing into contact with the positioning plate 104, and screwing to the nut 106*e* by inserting a bolt 107 from the mounting hole 102*a* on the front side. The mounting state of the wheel unit U can be strengthened by inserting at the same time a bolt 107 also from the mounting hole 102*b* on the side face side and screwing to the nut 106*f*. It may also be fixed by a single bolt 107 by selecting either one. In the returnable case of FIG. 1 also, the wheel unit U can be attached by using the recess 13 shown in FIG. 17, and submitting the corner fitting to the processing of a mounting hole. It should be noted that the mounting means of wheel unit U can use a pin, not with bolt and nut. A returnable case provided with a wheel at the bottom four corners can secure the facility and workability of handling baggage, because it can be pushed by hand by the operator. If the wheel of the wheel unit U is composed of a caster, the facility and workability of handling baggage can further be enhanced, because the direction can be changed as desired for displacement. Also, when the wheel is unnecessary, as in case of staking up returnable cases, the wheel unit U can be removed easily from the corner fitting 102 by extracting the bolt 107.

Figure 21:
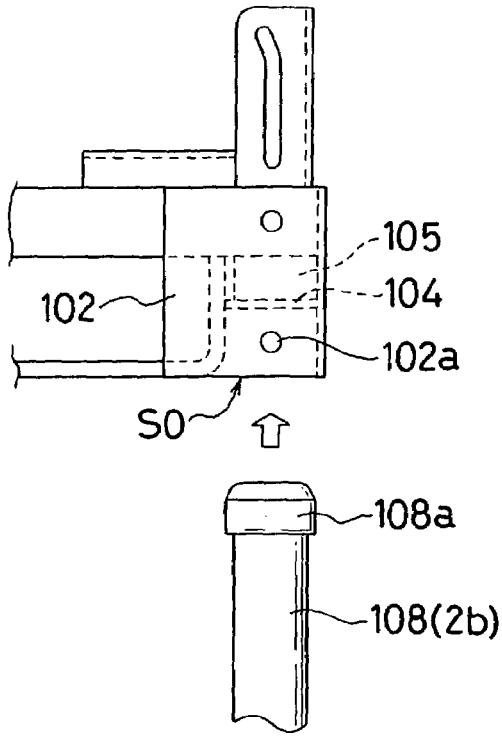
FIG. 21 is a state drawing before post insertion, showing an embodiment so developed that it can be confirmed easily if a post is inserted securely in a corner fitting, when returnable cases are stacked up.

FIG. 21 is shows an embodiment so developed that it can be confirmed easily if four posts (more precisely, vertical frame member 2*b*) are inserted securely in the corner fitting 102, when returnable cases are stacked up. In short, an insertion portion 108*a* is provided at the tip (upper extremity) of the post 108 of the returnable case, and the insertion portion 108*a* is colored with a paint and so on. The coloring is not particularly specified, but it is preferable to paint with a color remarkable from distance, for example, yellow.

Returnable cases are stacked by inserting the insertion portion 108*a* of the aforementioned post 108 into the space portion S0 of the corner fitting 102. At this time, if the insertion portion 108*a* is inserted correctly into the space portion S0, the mounting holes 102*a* and 102*b* are obstructed with the insertion portion 108*a* from inside. Consequently, the color of the insertion portion 108*a* can be seen from outside through the mounting holes 102*a* and 102*b*. In case where the color can not be recognized or can not be seen clearly, the insertion state into the corner fitting 102 is not good, being capable of confirming easily that the insertion portion 108*a* is deviated. As a result, the safety of stacked returnable cases can be secured. Such a confirmation means can be applied similarly to the returnable case as shown in FIG. 1.

Figure 22:
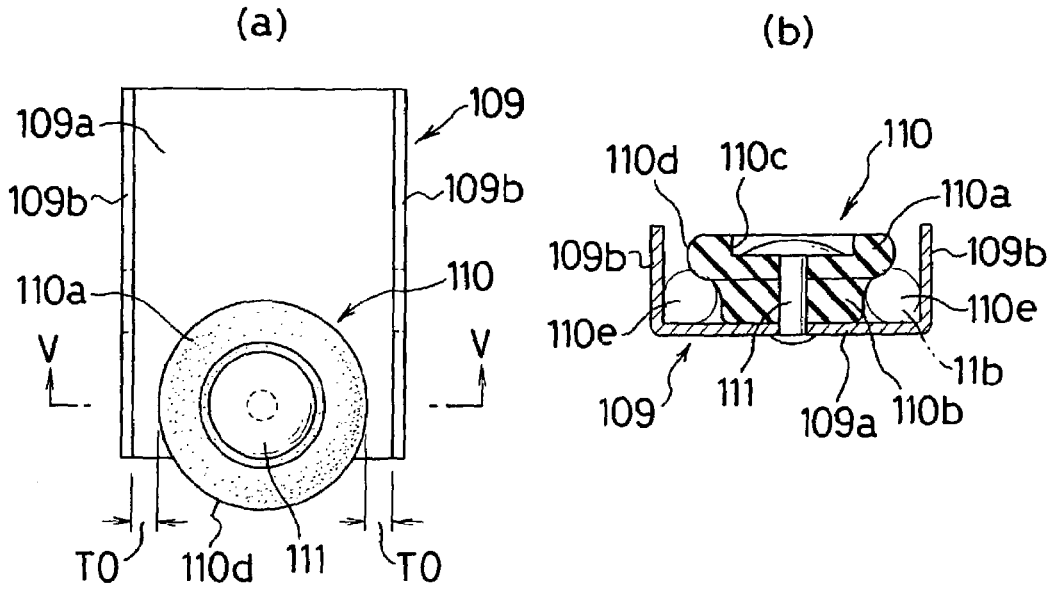
FIG. 22 is an embodiment wherein a lock member is developed, (*a*) is a front view of a retention member, and (*b*) cross sectional view taken along line V—V thereof.

FIG. 22 shows an embodiment wherein a lock member 4 is developed, and an example of improvement of the retention member 12 for holding the slide bar 11. A retention member 109 in the present embodiment is provided with a vertical substrate 109*a* and bent pieces 109*b* erected at both ends thereof as shown in FIGS. 22(*a*), (*b*) and is a composition having a socket 110 at the lower part of the vertical substrate 109*a*.

The aforementioned socket 110 is made for example of silicon rubber, comprised of an upper member 110*a* and a lower member 110*b*, and fixed to the vertical substrate 109*a* by a latch 111 such as rivet penetrating through the central portion. As FIG. 22(*b*), the upper member 110*a* has a disk shape, and a round recess 110*c* disposed at the center, and the head of the latch 111 is contained in the recess 110*a*, the outer periphery of surrounding annular portion 110*d* is rounded outward, and an interval T0 between the outer peripheral edge and the both ends bent piece 109*b* is set to a dimension smaller than the cross-sectional diameter of the handle 11*b* of the slide bar 11. Also, the lower member 110*b* presents a cylindrical shape of a diameter slightly smaller than the upper member 110*a*, the outer periphery is rounded inwards concavely, and a fixing portion 110*e* for holding respectively the handle 11*b* of the slide bar 11 is provided between the outer peripheral edge thereof and both ends bent piece 109*b*.

In this case, if the handle 11*b* of the slide bar 11 is pushed powerfully into the interval T0, the annular portion 110*d* yields slightly inward by elasticity to enlarge the interval T0, the handle 11*b* passes and fits to the fixing portion 110*e*. After the passage of the handle 11*b*, the annular portion 110*d* restores to its original state by elasticity reducing the interval T0, inhibiting the handle to move in the opposite direction and pass through. As the result, the handle 11*b* can be locked by holding in the fixing portion 110*e*. On the other hand, if the handle 11*b* is pulled strongly to near side from the locked state, the handle 11*b* enlarges the interval T0, passes through and comes off from the retention member 109.

Figure 10:
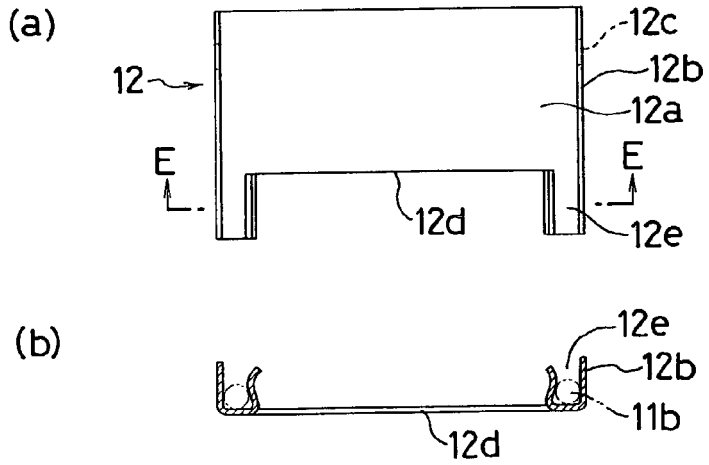
FIG. 10(*a*) is a front view of a retention member in a lock member of the returnable case according to the embodiment of the present invention and (*b*) is a sectional view taken along line E—E thereof.

If an external force such as impact is applied to the lock member 4 during transport of the returnable case, in case of the retention member shown in FIG. 10 or FIG. 11, it is feared that the fixing portion thereof deforms, and the lock function lowers remarkably and the handle 11*b* deviates especially therefrom when the fixing portion comes in an open state; however, according to the retention member 109 of the present embodiment, the lock function is prevented from lowering because the external force such as impact is absorbed or attenuated by the socket 110 made of silicon rubber. Such a retention member 109 can be applied to the lock member 4.

Since the socket 110 is made of silicon rubber, its elasticity and durability are excellent, it is free from troubles such as break, damage and so on, different from synthetic resin, and its maintenance is extremely easy. The socket 110 is preferably formed by integrating the upper member 110*a* and the lower member 110*b* with silicon rubber, but it is not limited to this, and the lower member 110*b* can be formed of another material.

While the presently preferred embodiment of the present invention has been shown and described, it will be understood that the present invention is not limited thereto, and that various changes and modifications may be made by those skilled in the art without departing from the scope of the invention as set forth in the appended claims.

What is claimed is:

1. A returnable case, comprising a bottom member, left and right side members provided foldable inward in regard to the bottom member, and front and back side members detachable in regard to the bottom member and formed two-foldable taking the longitudinal direction as a boundary, in which contact ends of said left and right side members and said front and back side members are disposed enabling to look and unlock by a lock member, wherein said front and back side members are formed foldable inward by pivotally supporting respective lower ends with the bottom member, wherein said front and back side members have a pair of engagement bars attached to the lower end, and when the engagement bars are fitted to a pair of supporting reception members provided on said bottom member, the front and back side members can rotate by taking the supporting reception member as a fulcrum, and when the engagement bars are removed from the supporting reception member, the front and back side members can be extracted from the bottom member, and wherein for the pair of engagement bars attached to the lower ends of said front and back side members, the length of any one of engagement bars is set shorter than the length of the other engagement bar.

2. The returnable case of claim 1, wherein said lock member has a slide bar attached to the ends of the front and back side members through a retention member, and a bent portion disposed at the tip of the slide bar, said lock member is formed to jock by passing the bent portion through an engagement long hole disposed on a vertical frame member of the left and right side members and, at the same time, axially rotating the slide bar by 90 degrees, and to unlock by axially rotating the slide bar by 90 degrees in the opposite direction from the locked state and extracting the same from the long hole, and wherein said retention member is provided with a fixation portion at both ends of said retention member to which a spring action is afforded and the slide bar is formed enabling to fit or to detach from the fixation portion.

3. The returnable case of claim 1, wherein a wheel is composed to be able to be mounted detachably, for a corner fitting fixed to the outside of an edge corner of said bottom member, and wherein a hole is formed on the corner fitting fixed to the outside of the edge corner of said bottom member and a colored insertion portion is installed at an upper end of a vertical frame member for the left and right side members, allowing to view the colored insertion portion from the exterior through said hole, when returnable cases are stacked up with the insertion portion inserted in said corner fitting.

4. A returnable case, comprising a bottom member, left and right side members provided foldable inward in regard to the bottom member, and front and back side members detachable in regard to the bottom member and formed two-foldable taking the longitudinal direction as a boundary, in which contact ends of said left and right side members and said front and back side members are disposed enabling to lock and unlock by a lock member, wherein said front and back side members are formed foldable inward by pivotally supporting respective lower ends with the bottom member, wherein said lock member has a slide bar attached to the ends of the front and back side members through a retention member, and a bent portion disposed at the tip of the slide bar, said rock member is formed to lock by passing the bent portion through an engagement long hole disposed on a vertical frame member of the left and right side members and, at the same time, axially rotating the slide bar by 90 degrees, and to unlock by axially rotating the slide bar by 90 degrees in the opposite direction from the locked state and extracting the same from the long hole, and wherein said retention member is provided with a vertical substrate and bent pieces erected at both ends thereof, a socket made of silicon rubber is fixed to the lower part of the vertical substrate, a fixing portion of the slide bar is composed of the socket and said bent piece, and the slide bar is formed to be able to fit or detach the slide bar to or from the fixing portion.

* * * * *

UNITED STATES PATENT AND TRADEMARK OFFICE

CERTIFICATE OF CORRECTION

PATENT NO. : 6,981,605 B2
APPLICATION NO. : 10/435726
DATED : January 3, 2006
INVENTOR(S) : Kiyoshi Kasuya et al.

It is certified that error appears in the above-identified patent and that said Letters Patent is hereby corrected as shown below:

Column 6, line 14, “if” should read --1 f--; and

Column 14, line 9, “jock” should read --lock--.

Signed and Sealed this

First Day of August, 2006

JON W. DUDAS
*Director of the United States Patent and Trademark Office*